United States Patent [19]

Kurland et al.

[11] Patent Number: 4,459,927

[45] Date of Patent: Jul. 17, 1984

[54] ARRANGEMENT FOR SIGNALING PRESSER BAR POSITION

[75] Inventors: Marvin Kurland, East Brunswick; Ferdinand P. Oliva, Cranford; Terry L. Wilson, Denville, all of N.J.

[73] Assignee: The Singer Company, Stamford, Conn.

[21] Appl. No.: 560,292

[22] Filed: Dec. 12, 1983

[51] Int. Cl.[3] ..... D05B 29/00

[52] U.S. Cl. ..... 112/237; 112/158 E

[58] Field of Search ..... 112/237, 158 E, 238, 112/277, 273, 235

[56] References Cited

U.S. PATENT DOCUMENTS 2,962,992 12/1960 Johnson et al. .

3,669,050 6/1972 Adams ..... 112/237

3,777,685 12/1973 Baruffa ..... 112/237 X 4,409,913 10/1983 Adams et al. .

FOREIGN PATENT DOCUMENTS 40-4283 2/1965 Japan .

*Primary Examiner*—Werner H. Schroeder

*Assistant Examiner*—Andrew M. Falik

*Attorney, Agent, or Firm*—David L. Davis; Robert E. Smith; Edward L. Bell

[57] ABSTRACT

An arrangement for changing the condition of an electrical circuit path when the presser bar lifter is pivoted to lift the presser bar uses a modified thread tension release cam which pivots with the presser bar lifter and a contact strip which is adapted to contact the cam when the presser bar is raised.

6 Claims, 3 Drawing Figures

ARRANGEMENT FOR SIGNALING PRESSER BAR POSITION

DESCRIPTION

Background of the Invention

This invention relates to sewing machines and, more particularly, to an arrangement in a sewing machine for providing an electrical signal indicative of the position of the presser bar.

There are many instances where it is desirable to know the position of the presser bar in a sewing machine so that a control device within the sewing machine can take appropriate action depending upon such position. For example, it is typical to release thread tension when the presser bar is raised and, accordingly, it is therefor desirable to not run the sewing machine with the presser bar raised so as to avoid thread jamming. In the past, it has been proposed to provide a separate switch mounted in the head of the sewing machine and positioned so that its actuator is engaged when the presser bar is raised. However, such an arrangement is not entirely satisfactory due to the expense of providing a separate switch. Accordingly, it is an object of the present invention to provide an arrangement in a sewing machine for indicating the position of the presser bar, which arrangement is economical in construction and design.

SUMMARY OF THE INVENTION

The foregoing and additional objects are attained in accordance with the principles of this invention in combination with a sewing machine having a bracket arm including a head, a mounting plate secured in the head, a presser bar mounted on the mounting plate, and a presser bar lifter pivotably mounted on the mounting plate and adapted to raise the presser bar, by providing an arrangement for changing the condition of an electrical circuit path when the presser bar lifter is pivoted to lift the presser bar, the arrangement comprising a first switch contact member supported on the plate, a second switch contact member mounted for pivotal movement with the presser bar lifter, the second switch contact member being contoured so that it is spaced from the first switch contact when the presser bar lifter is in one of its lowered or raised positions and it contacts the first switch contact member when the presser bar lifter is pivoted to its other position, first connection means for electrically connecting the first switch contact member serially in a first leg of the electrical circuit path, and second connection means for electrically connecting the second switch contact member serially in a second leg of the electrical circuit path.

In accordance with an aspect of this invention, the arrangement further includes an electrically insulating support member mounted on the plate, and means for mounting the first switch contact member on the support member so that the first switch contact member is maintained electrically insulated from the plate and the presser bar lifter, wherein the presser bar lifter is electrically conductive and the second switch contact member is in electrical contact with the presser bar lifter.

In accordance with another aspect of this invention, an electrically conductive collar member surrounds and is secured to the presser bar, the collar member having a cam follower extension which cooperates with the presser bar lifter for raising the presser bar, the first connection means includes an electrical lead wire connected to the first switch contact member and the second connection means includes an electrical lead wire connected to the collar member.

In accordance with a further aspect of this invention, the first switch contact member includes a contact portion spaced from the plate and extending toward the pivot axis of the presser bar lifter, the contact portion being yieldably biased toward the plate, and the second switch contact member is positioned between the contact portion and the plate, the second switch contact member including a generally circular wall portion of varying longitudinal dimension.

In accordance with yet another aspect of this invention, the wall portion is stepped to two defined levels.

In accordance with still a further aspect of this invention, the second switch contact is formed as part of the cam for releasing thread tension when the presser bar is raised.

BRIEF DESCRIPTION OF THE DRAWINGS

The foregoing will be readily apparent upon reading the following description in conjunction with the drawings in which like elements in different figures thereof have the same reference character applied thereto and wherein.

DETAILED DESCRIPTION

Figure 1:
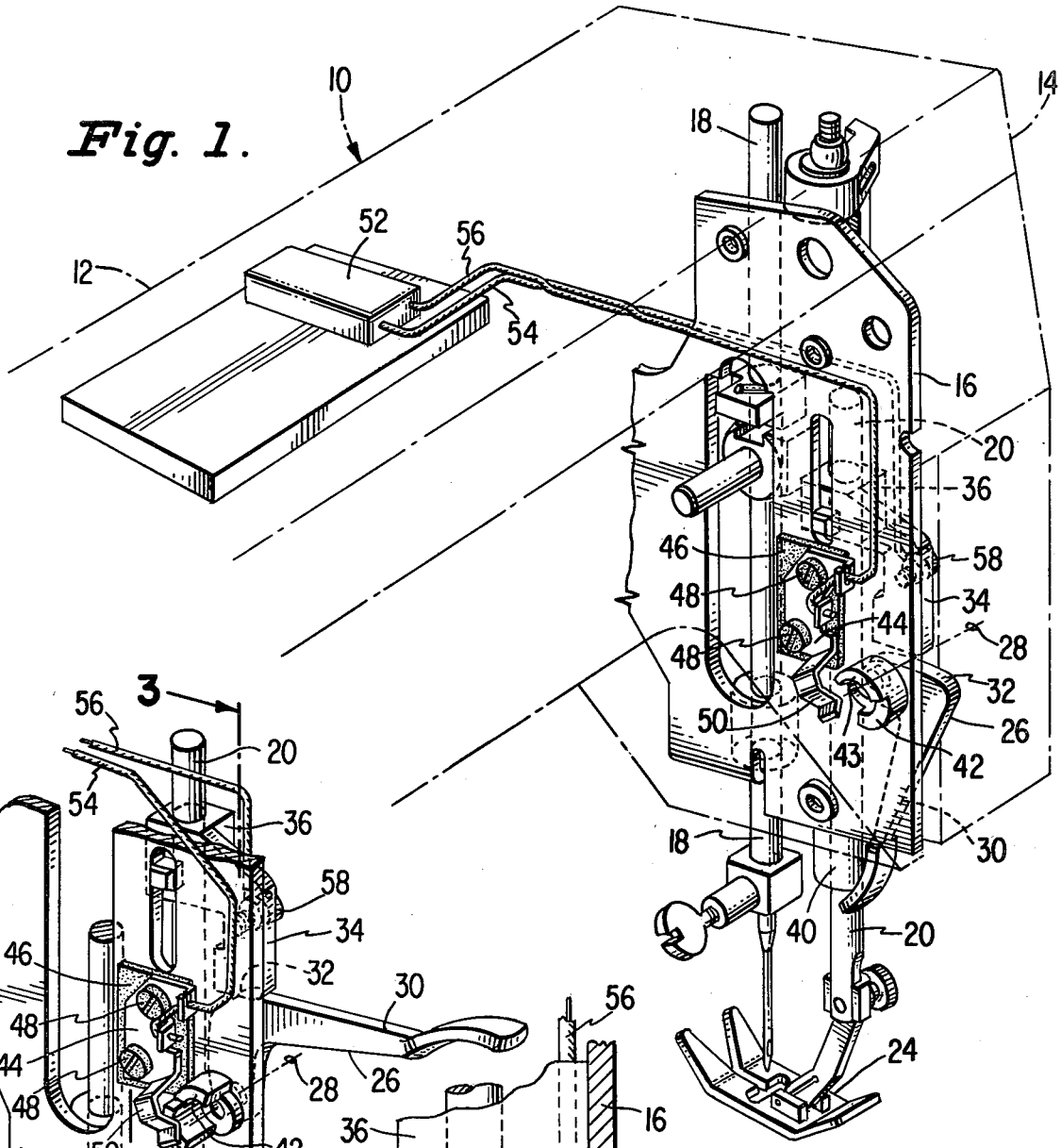
FIG. 1 is a perspective view of a portion of the head end of a sewing machine, showing the arrangement according to this invention, with the presser bar in its lowered position.

Referring now to the drawings, FIG. 1 shows in phantom a portion of a sewing machine 10. In particular, this portion is part of the bracket arm 12, which includes a head 14. A mounting plate 16 is secured in the head 14 in a conventional manner. The mounting plate 16 has mounted thereon a laterally jogable needle bar gate holding a needle bar 18. A presser bar 20 is also mounted on the mounting plate 16 in a conventional manner so that the presser bar 20 may be selectively raised or lowered by the sewing machine operator. Illustratively, a spring 22 provides a downward biasing force to the presser bar 20 so that a presser foot 24 clamped to the lower end of the presser bar 20 exerts a holding force on a work fabric being sewn on the sewing machine, as is well known. To enable the operator to raise the presser bar, there is provided a presser bar lifter 26 pivotally mounted on the mounting plate 16 for rotation about a pivot axis 28. The presser bar lifter 26 includes a lever portion 30 and a cam portion 32. The cam portion 32 is adapted to cooperate with the cam follower extension 34 of the collar member 36 which surrounds and is secured to the presser bar 20 so that a pivoting action of the presser bar lifter 26 causes the presser bar 20 to be raised against the force of the spring 22, one end of which is secured to the stub 38 of the collar member 36, surrounding the presser bar 20, and the other end of which is secured to a stub on the presser bar bushing 40 which is mounted on the plate 16. It is customary in the sewing machine art to release the thread tension whenever the presser bar is raised. Toward that end, a cam 42 is provided. The cam 42 is mounted for pivotal movement with the presser bar lifter 26 about the pivot axis 28 and is adapted to engage a mechanism (not shown) for releasing the thread tension when the presser bar lifter 26 is pivoted to raise the presser bar 20. The aforedescribed structure is conventional in the sewing machine art.

In accordance with the principles of this invention, the tension releasing cam 42 is utilized to form part of a switch for providing a electrical indication whenever the presser bar is raised. Another part of the switch comprises a switch contact member 44 which is illustratively a beryllium copper strip. The beryllium copper strip 44 is supported on the mounting plate 16 but is separated therefrom by an insulating support member 46. The strip 44 and the member 46 are secured to the mounting plate 46 by insulating screws 48. The mounting plate 16 is electrically conductive and thus the switch contact member 44 is maintained electrically insulated from the plate 16. The strip 44 is formed, as by cutting and bending, with a contact portion 50 spaced outwardly from the plate 16 and extending toward the pivot axis 28, and due to the nature of the strip 44, the contact portion is yieldably biased toward the plate 16.

Figure 2:
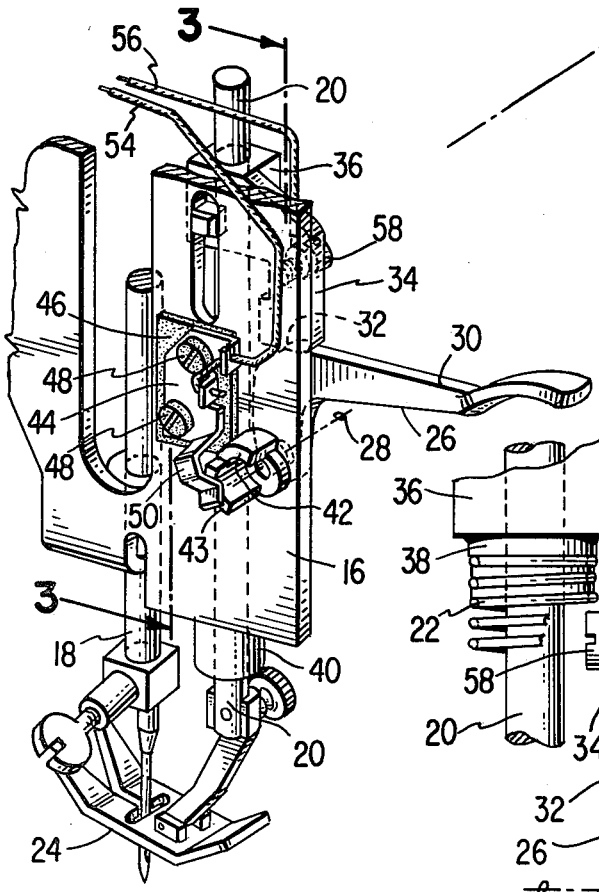
FIG. 2 is a view similar to FIG. 1 showing the presser bar in its raised position.
Figure 3:
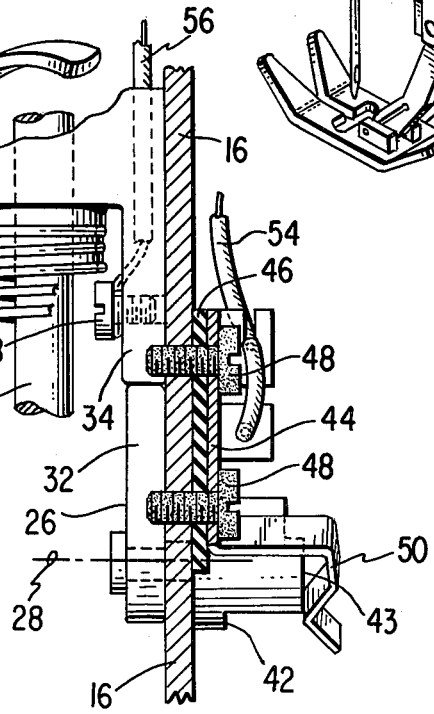
FIG. 3 is a sectional view taken along the line 3—3 in FIG. 2.

As is shown clearly in FIGS. 1 and 2, the tension release cam 42 includes a generally circular wall portion. When the cam 42 is modified according to the present invention to act as a switch contact, the wall portion is contoured to have a varying longitudinal dimension. Illustratively, the wall portion has an increased step 43 added thereto. The angular orientation of the wall portion of the tension release cam 42 with respect to the pivot axis 28 is such that the increased step 43 of the wall portion is opposite and engages the contact portion 50 when the presser bar is in its raised position. It is understood that the reverse set of conditions would also be effective so that contact could be made when the presser bar is lowered.

It is thus seen that the cam 42 and the strip 44 together form an electrical switch. The cam 42 is connected serially in a first leg of an electrical circuit path and the strip 44 is connected serially in a second leg of the electrical circuit path, this circuit path terminating the strip 44 is connected serially in a second leg of the electrical circuit path, this circuit path terminating within control circuitry 52 mounted in the sewing machine 10. The control circuitry 52 is illustratively part of a microcomputer based controller for the sewing machine 10. An electrical lead wire 54 connects the control circuitry 52 to the switch contact member 44. An electrical lead wire 56 is connected to the cam follower extension 34, as by a contact screw 58. The collar member 36 is electrically conductive, as are the presser bar lifter 26 and the cam 42. Thus, when the presser bar 20 is raised by the pivoting action of the presser bar lifter 26, a circuit path is completed from the control circuitry 52, through the lead wire 54, to the switch contact member 44, through the contact portion 50, through the step 43 of the cam 42, through the presser bar lifter 26, through the cam follower extension 34, and through the lead wire 56 back to the control circuitry 52. Since the contact portion 50 is yieldably biased toward the plate 16, good contact is maintained between the contact portion 50 and the step 43 of the wall portion of the cam 42. Since the cam follower extension 34 is forced toward the presser bar lifter 26 by the spring 22, good contact is maintained between the cam follower extension 34 and the presser bar lifter 26.

Accordingly, there has been disclosed an improved arrangement for changing the condition of an electrical circuit path when the presser bar lifter is pivoted to lift the presser bar of a sewing machine. It is understood that the above-described embodiment is merely illustrative of the application of the principles of this invention. Numerous other embodiments may be devised by those skilled in the art without departing from the spirit and scope of this invention, as defined by the appended claims.

We claim:

1. In combination with the sewing machine having a bracket arm including a head, a mounting plate secured in said head, a presser bar mounted on said mounting plate, and a presser bar lifter pivotally mounted on said mounting plate and adapted to raise said presser bar, an arrangement for changing the condition of an electrical circuit path when said presser bar lifter is pivoted to lift said presser bar comprising:

a first switch contact member supported on said plate;

a second switch contact member mounted for pivotal movement with said presser bar lifter, said second switch contact member being contoured so that it is spaced from said first switch contact member when said presser bar lifter is in one of its lowered or raised positions and it contacts said first switch contact member when said presser bar lifter is pivoted to its other position;

first connection means for electrically connecting said first switch contact member serially in a first leg of said electrical circuit path; and second connection means for electrically connecting said second switch contact member serially in a second leg of said electrical circuit path.

2. The arrangement according to claim 1 further including:

a electrically insulating support member mounted on said plate; and means for mounting said first switch contact member on said support member so that said first switch member is maintained electrically insulated from said plate and said presser bar lifter;

wherein said presser bar lifter is electrically conductive and said second switch contact member is in electrical contact with said presser bar lifter.

3. The arrangement according to claim 2 wherein an electrically conductive collar member surrounds and is secured to the presser bar, the collar member having a cam follower extension which cooperates with the presser bar lifter for raising the presser bar, said first connection means includes an electrical lead wire connected to said first switch contact member and said second connection means includes an electrical lead wire connected to said collar member.

4. The arrangement according to claim 3 wherein said first switch contact member includes a contact portion spaced from said plate and extending toward the pivot axis of said presser bar lifter, said contact portion being yieldably biased toward said plate, and said second switch contact member is positioned between said contact portion and said plate, said second switch contact including a generally circular wall portion of varying longitudinal dimension.

5. The arrangement according to claim 4 wherein said wall portion is stepped to two defined levels.

6. The arrangement according to claim 5 wherein said second switch contact member is formed as part of the cam for releasing thread tension when the presser bar is raised.

* * * * *